US006050439A

United States Patent [19]

Chilewich et al.

[11] Patent Number: 6,050,439

[45] Date of Patent: Apr. 18, 2000

[54] OPEN-FACED RECEPTACLE WITH REMOVABLE FABRIC RECEIVING FACE

[75] Inventors: Sandra Chilewich; Joseph Sultan, both of New York, N.Y.; Julio Garciafigueroa, Rutherford, N.J.

[73] Assignee: Sandra Chilewich, L.L.C., New York, N.Y.

[21] Appl. No.: 09/168,402

[22] Filed: Oct. 6, 1998

Related U.S. Application Data

[63] Continuation-in-part of application No. 08/824,166, Mar. 26, 1997, Pat. No. 5,829,618.

[51] Int. Cl.[7] ..... B65D 33/02

[52] U.S. Cl. ..... 220/9.4; 220/495.03; 220/574.3

[58] Field of Search ..... 220/9.4, 9.3, 9.2, 220/9.1, 904, 495.11, 495.08, 495.06, 495.01, 574.3, 495.03; 383/119

[56] References Cited

U.S. PATENT DOCUMENTS

| | | | |
|---|---|---|---|
| 1,827,232 | 10/1931 | Henry | 220/9.2 |
| 3,026,539 | 3/1962 | Lewis | 220/9.1 |
| 3,372,725 | 3/1968 | Voorhees . | |
| 3,396,885 | 8/1968 | Giondi | 220/9.1 |
| 5,474,188 | 12/1995 | McArdle | 211/85.4 |
| 5,562,225 | 10/1996 | McKenna | 220/9.1 |
| 5,829,618 | 11/1998 | Chilewich et al. | 220/9.4 |
| 5,913,440 | 6/1999 | Bobko et al. | 220/9.4 |

*Primary Examiner*—Stephen Castellano

*Attorney, Agent, or Firm*—Gottlieb, Rackman & Reisman, P.C.

[57] ABSTRACT

An improved open-faced receptacle with a removable fabric receiving face is provided. The receptacle comprises a frame, fabric which is selectively removable from around a portion of the frame creating a receiving face for the receptacle and a securing assembly which tautly holds a central portion of the fabric to a lower portion of the frame so that the receiving face assumes a concave shape. The frame has an upper geometrically shaped opening, which forms the upper rim of the open-faced receptacle, and a lower portion which supports the receptacle. The fabric is substantially configured to conform to the shape of this upper rim portion of the frame, with some slack in the fabric so that it can be pulled taunt by the securing assembly to create the taunt concave shape which acts as the receiving face of the receptacle. The securing assembly comprises a hook member which extends through an opening in a central portion of the fabric, a hold-down member and a bar member. The hold-down member works with the portion of the hook member above the opening in the fabric and acts to grab a small central portion of the fabric and pull it down to create the taunt concave receiving face, when the portion of the hook below the opening is secured to the bar member. The bar member is itself secured to the frame.

18 Claims, 13 Drawing Sheets

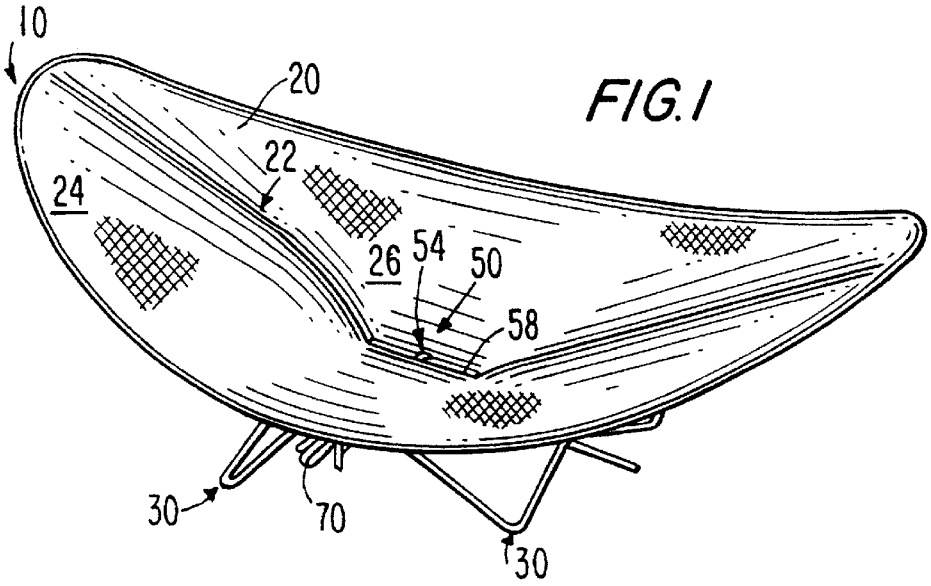
FIG. 1
FIG. 2
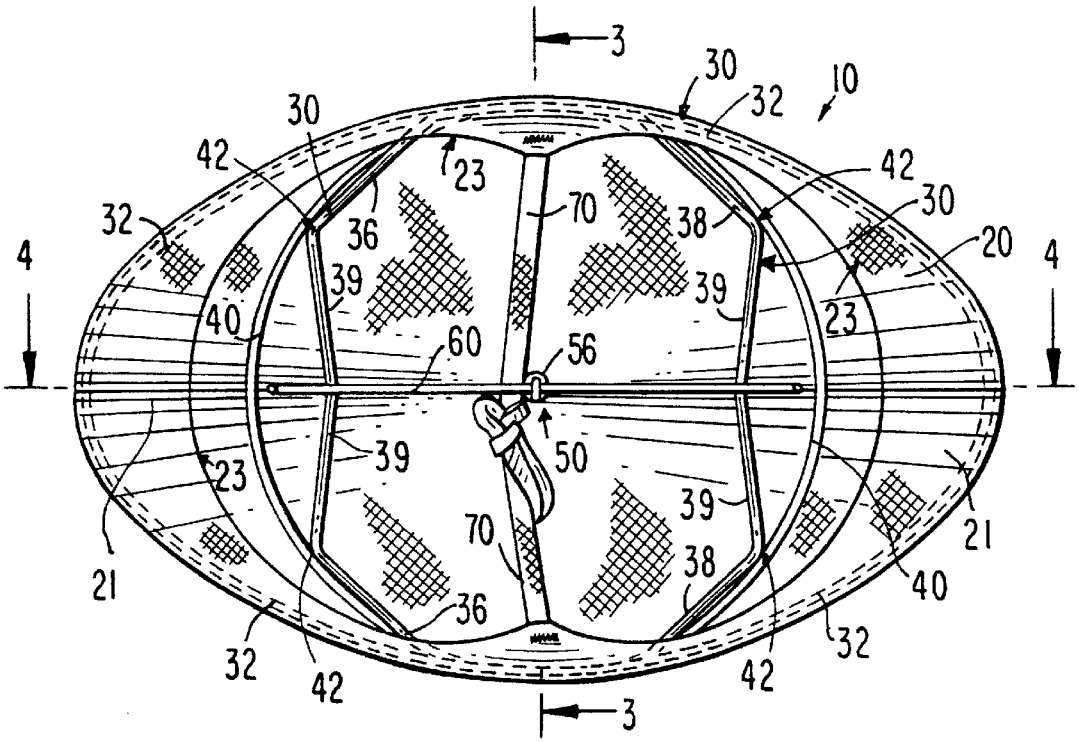

FIG. 18
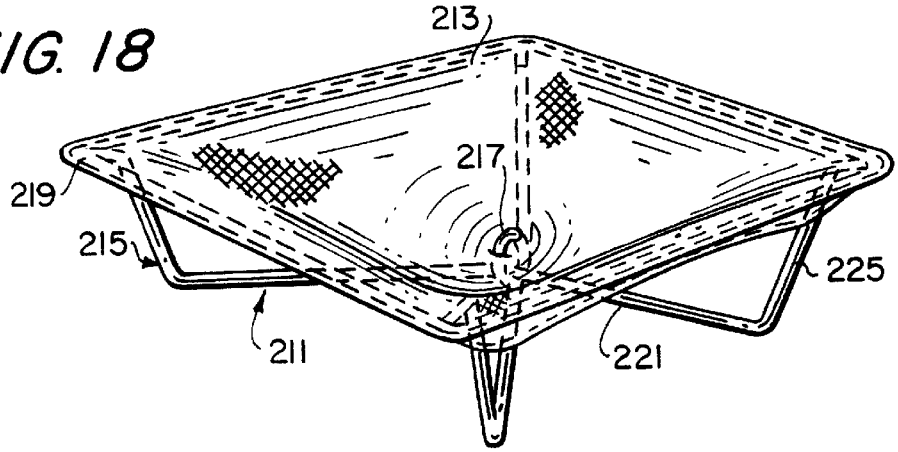
FIG. 19
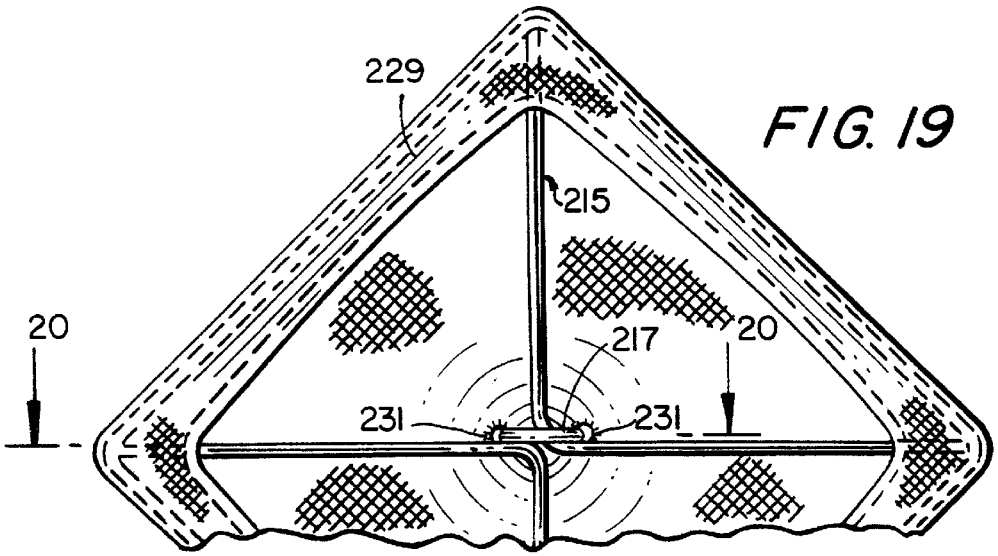
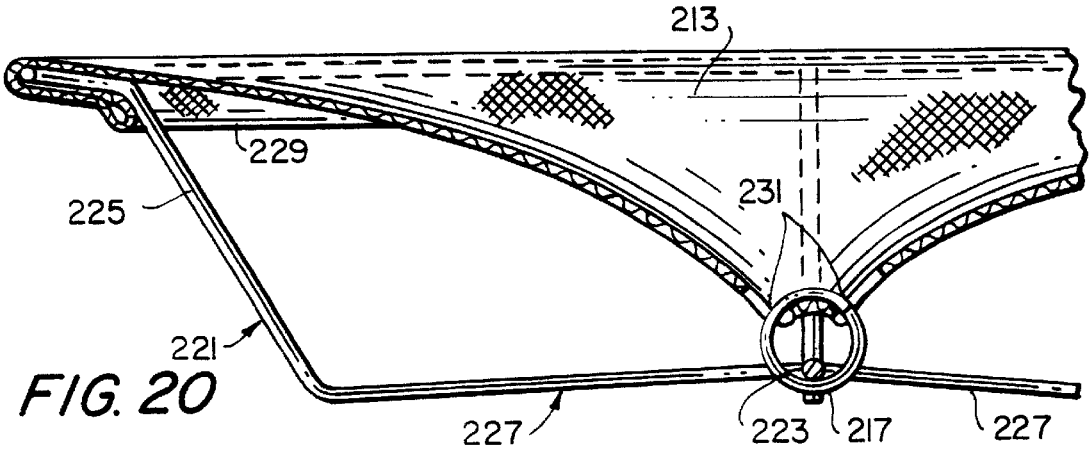
FIG. 20

FIG. 24
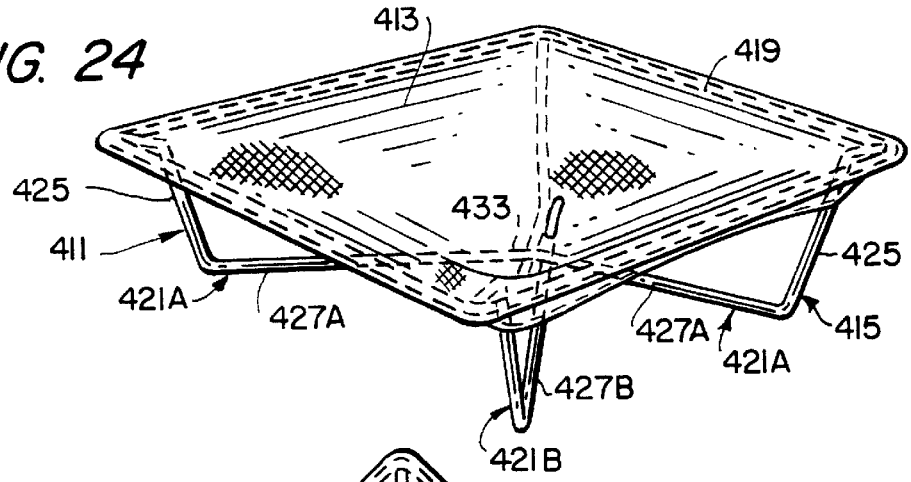
FIG. 25
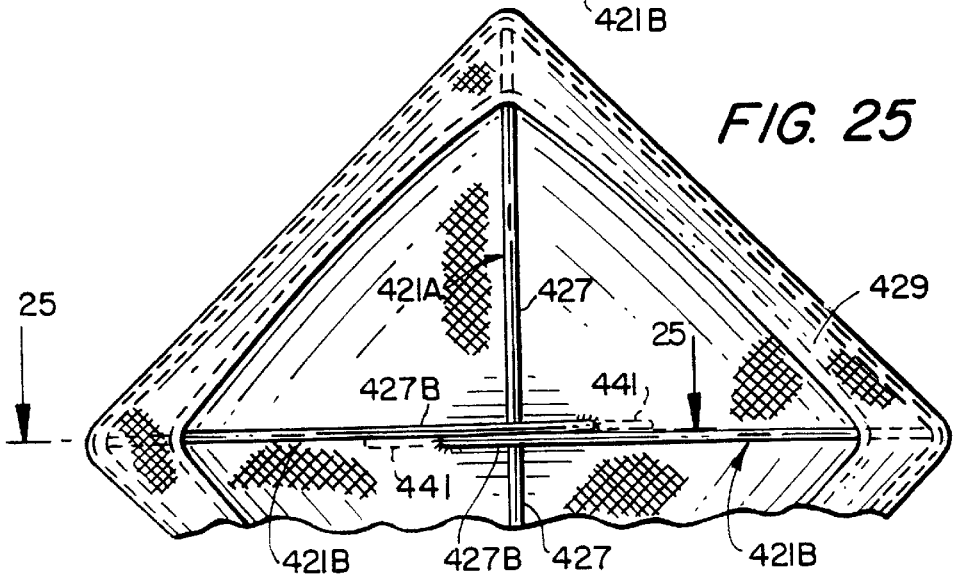
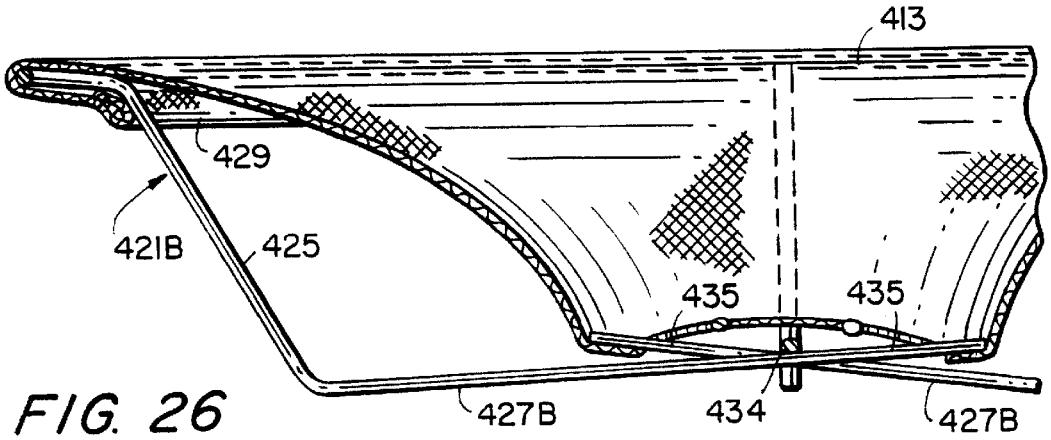
FIG. 26

FIG. 27
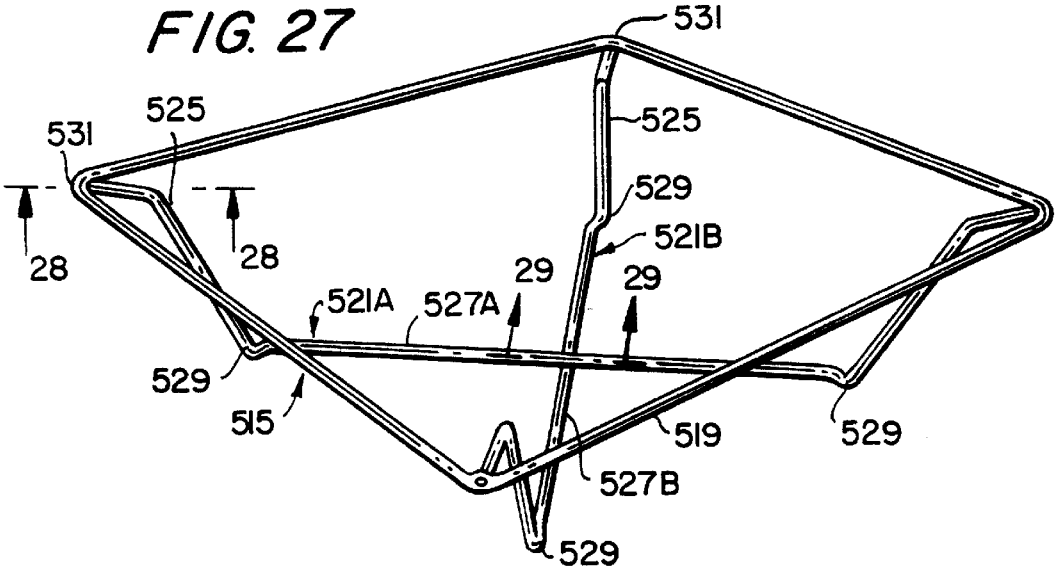
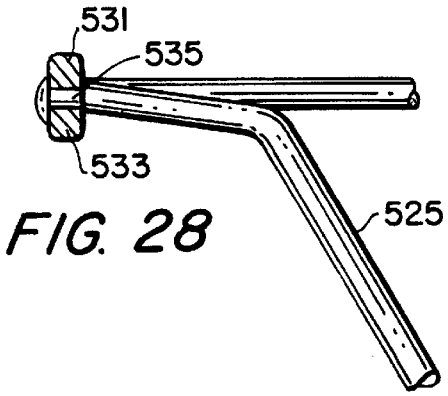
FIG. 28
FIG. 29
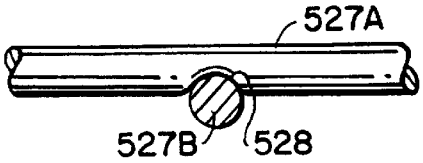
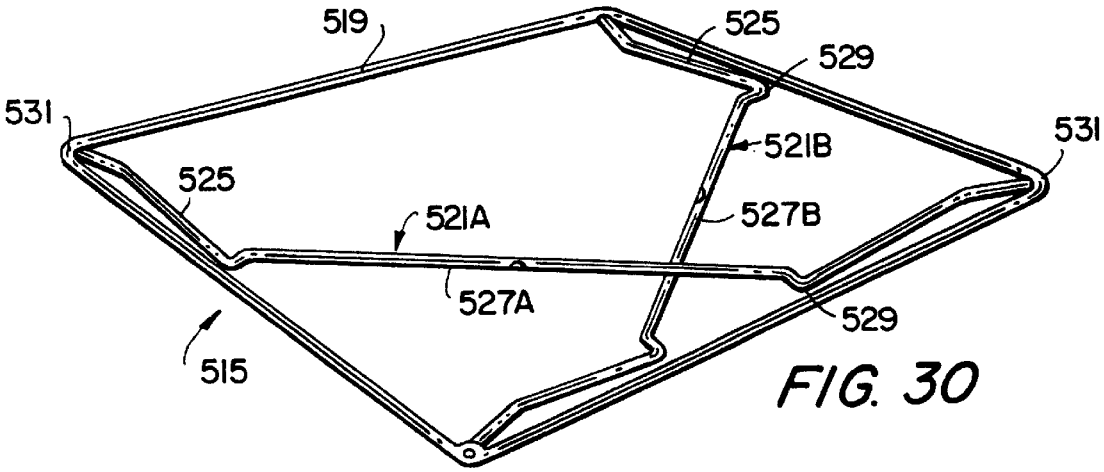
FIG. 30

OPEN-FACED RECEPTACLE WITH REMOVABLE FABRIC RECEIVING FACE

This is a continuation-in-part of Ser. No. 08/824,166 filed Mar. 26, 1997, now U.S. Pat. No. 5,829,618.

BACKGROUND OF THE INVENTION

This invention relates to the receptacle field, and more particularly, to baskets, bowls and dishes, and the like, having a removable fabric receiving structure.

Baskets, bowls and dishes are well known receptacles for holding various household objects, which are old in the art. These prior art baskets, bowls and dishes are usually made from metal (precious and non-precious), ceramics, wood- and/or plastic or other rigid material. They have an upper concave receiving area for the holding of such household items as foods (candies, fruits, vegetables and snacks), and various nic-nacs such as tools, toys and papers.

Sometimes these prior art receptacles are used in association with some type of bag, so that the items being held within the receptacle are easily gathered for disposal. This basket/bag combination is normally found when speaking of garbage can receptacles.

The prior art is also composed of receptacles which are constructed of a frame assembly and an interior bag assembly. Such receptacles are normally used for garbage (as discussed above), or for items such as dirty laundry (a laundry hamper or bin) and a recyclable container. These receptacles are normally constructed so that the bag portion is somehow secured around or to the open rim of the receptacle frame. Such methods of attachment are by hooks (see U.S. Pat. No. 1,102,499 to Haist) or some type of pull-cord tieing member which is threaded around the bag's opening and can be draped over the receptacle frame rim and tied for security.

A disadvantage of this latter type of receptacle frame/bag combination is that the bag portion merely hangs within the receptacle having no shaped form. The only form attributable to these structures is given by the shape of the frame, or simply from the loose shape of a hanging sack. For example, when one thinks of the standard garbage pail and garbage bag combination, the bag has no real form other than that of a hanging sack within the confines of the framework of the garbage can. In another example, in the recycling canisters which have sprung up since the recycling craze, the frame of the recycling receptacle is usually merely a rectangular tubular structure with no side walls. In this situation, the bag portion of the combination is secured around the rim of the receptacle and merely hangs loosely down, taking many different shapes and forms as different recyclable elements are stored within.

Accordingly, it would be desirable to provide an open-faced receptacle wherein the removable fabric element does not simply hang—limp within the receptacle, but creates an attractive concave receiving face which is tautly held to the frame of the receptacle. This type of receptacle would be more suited for use in the house on tables or countertops as a bowl or dish for displaying foods.

Standard bowls and dishes, as discussed above, are decorative only in the shapes they are formed into and the materials used for that forming. For example, a silver dish may have a unique shape, while a crystal dish might have both a unique shape and a unique look due to the crystal structure. Further, plastic, ceramic and even wooden dishes and bowls can have different painted colors and designs. The disadvantage of all of these types of prior art bowls and dishes are that if the owner wants to change the design or the look of the bowl or dish, he/she must totally replace the bowl or dish with another bowl or dish which, of course, may be costly.

Accordingly, it would also be desirable to provide an open-faced receptacle wherein the fabric receiving face is removable for washing or replacement by another, interchangeable receiving face.

SUMMARY OF THE INVENTION

In accordance with the invention, an improved open-faced receptacle with a removable fabric receiving face is provided. The receptacle comprises a frame, fabric which is selectively removable from around a portion of the frame creating a receiving face for the receptacle, and a securing assembly which tautly holds a central portion of the fabric to a lower portion of the frame so that the receiving face assumes a concave shape. The frame has an upper geometrically shaped opening or periphery (round, oval, rectangular, square or triangular, or any combination thereof), which shape forms the upper rim of the open-faced receptacle, and a lower portion which supports the receptacle.

The fabric is substantially configured to conform to the shape of this upper rim portion of the frame, with some slack in the fabric so that it can be pulled taunt by the securing assembly to create the taunt concave shape which acts as the receiving face of-the bowl/dish. The securing assembly desirably comprises a hook member which extends through an opening in a central portion of the fabric, a hold-down member and a bar member. The hold-down member works in relation with the portion of the hook member above the opening in the fabric (on the receiving face side of the fabric), and acts to grab a portion of a central portion of the fabric and pull it down to create the taunt concave receiving face when the portion of the hook below the opening is secured to the bar member. The bar member is itself secured to the frame.

Accordingly it is an object of the invention to provide an improved open-faced receptacle.

Another object of the invention is to provide an open-faced receptacle with a removable fabric receiving face. Yet another object of the invention is to provide an open-faced receptacle wherein the removable fabric receiving face is selectively tautly held in a concave shape for the receipt of decorative and food items.

Still another object of the invention is to provide an open-faced receptacle wherein the fabric receiving face is easily removable for washing or interchangeable with another fabric receiving face through use of an easily manipulated securing assembly.

Other objects of the invention will in part be obvious and will in part be apparent from the following description.

The invention accordingly comprises assemblies possessing the features, properties and relation of components which will be exemplified in the products hereinafter described, and the scope of the invention will be indicated in the claims.

BRIEF DESCRIPTION OF THE DRAWINGS

For a fuller understanding of the invention, reference is made to the following description taken in connection with the accompanying drawings, in which:

FIG. 1 is a perspective view of an open-faced receptacle made in accordance with the invention;

FIG. 2 is a bottom plan view of the receptacle of FIG. 1, showing a removable bar member;

FIG. 18 is a perspective view of yet another embodiment of the inventive open-face receptacle;

FIG. 19 is a bottom plan view of the receptacle in FIG. 18;

FIG. 20 is a cross-sectional view taken along line 20—20 of FIG. 19;

FIG. 24 is a perspective view of another embodiment of the inventive open-faced receptacle;

FIG. 25 is a bottom plan view of the receptacle depicted in FIG. 24;

FIG. 26 is a cross-sectional view taken along 26—26 of FIG. 25;

FIG. 27 is a perspective view of an alternate version of a frame suitable for the inventive open-faced receptacle;

FIG. 28 is a cross-sectional view taken along line 28—28 of FIG. 27;

FIG. 29 is a cross-sectional view taken along line 29—29 of FIG. 27; and FIG. 30 is a perspective view of the frame depicted in FIG. 27 in a collapsed position.

DETAILED DESCRIPTION OF THE PREFERRED EMBODIMENT

Referring to FIGS. 1–5, a first embodiment of the inventive open-faced receptacle made in accordance with the invention and generally designated as 10, is shown. Receptacle 10 includes fabric 20, frame 30 and securing assembly 50.

Figure 3:
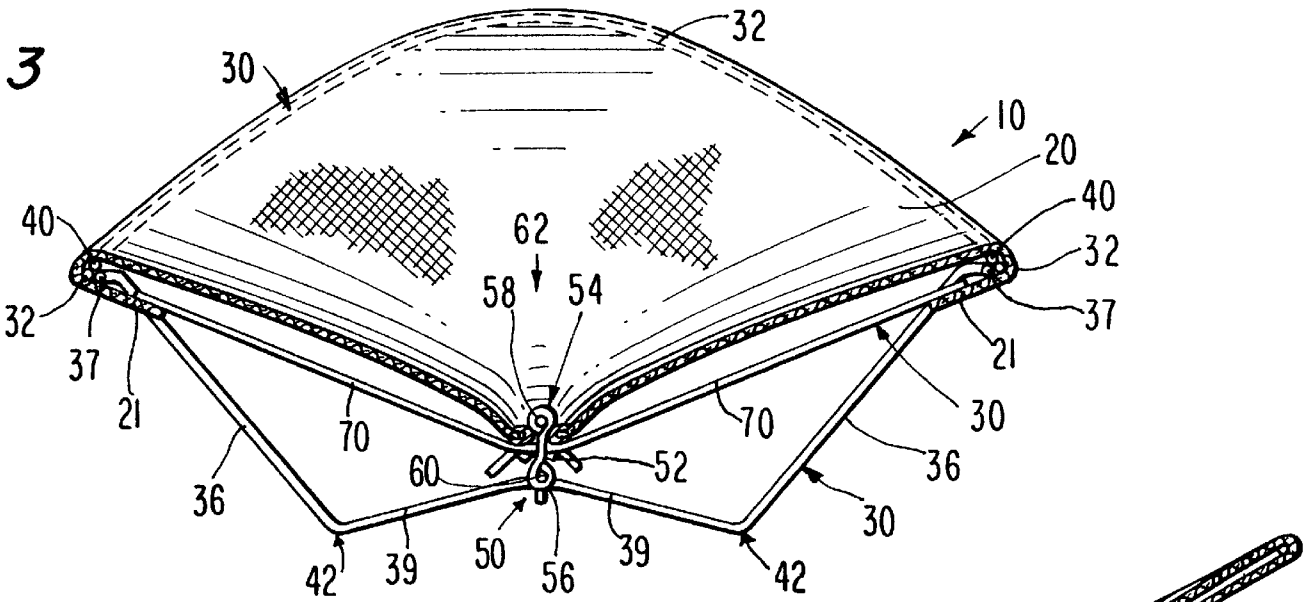
FIG. 3 is a cross-sectional view taken along line 3—3 of FIG. 2.
Figure 4:
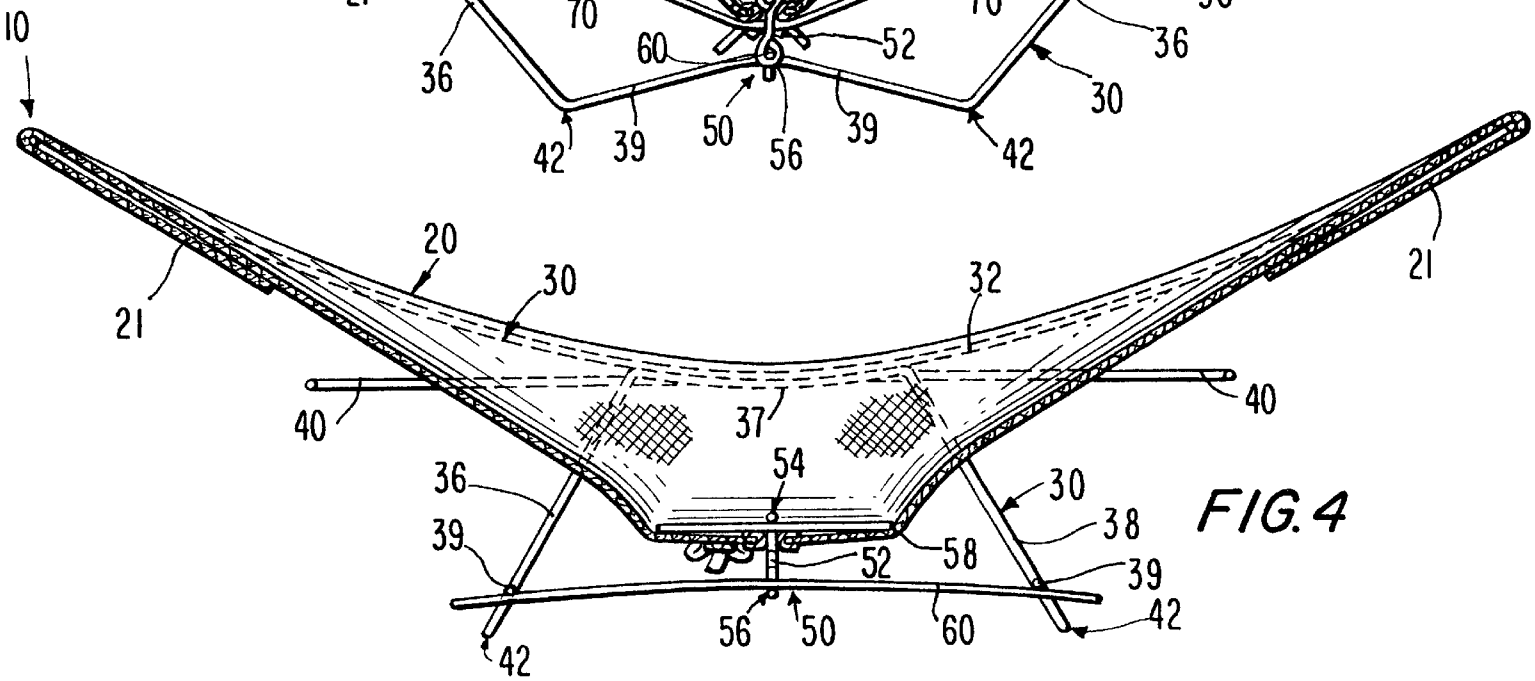
FIG. 4 is a cross-sectional view taken along line 4—4 of FIG. 2.
Figure 5:
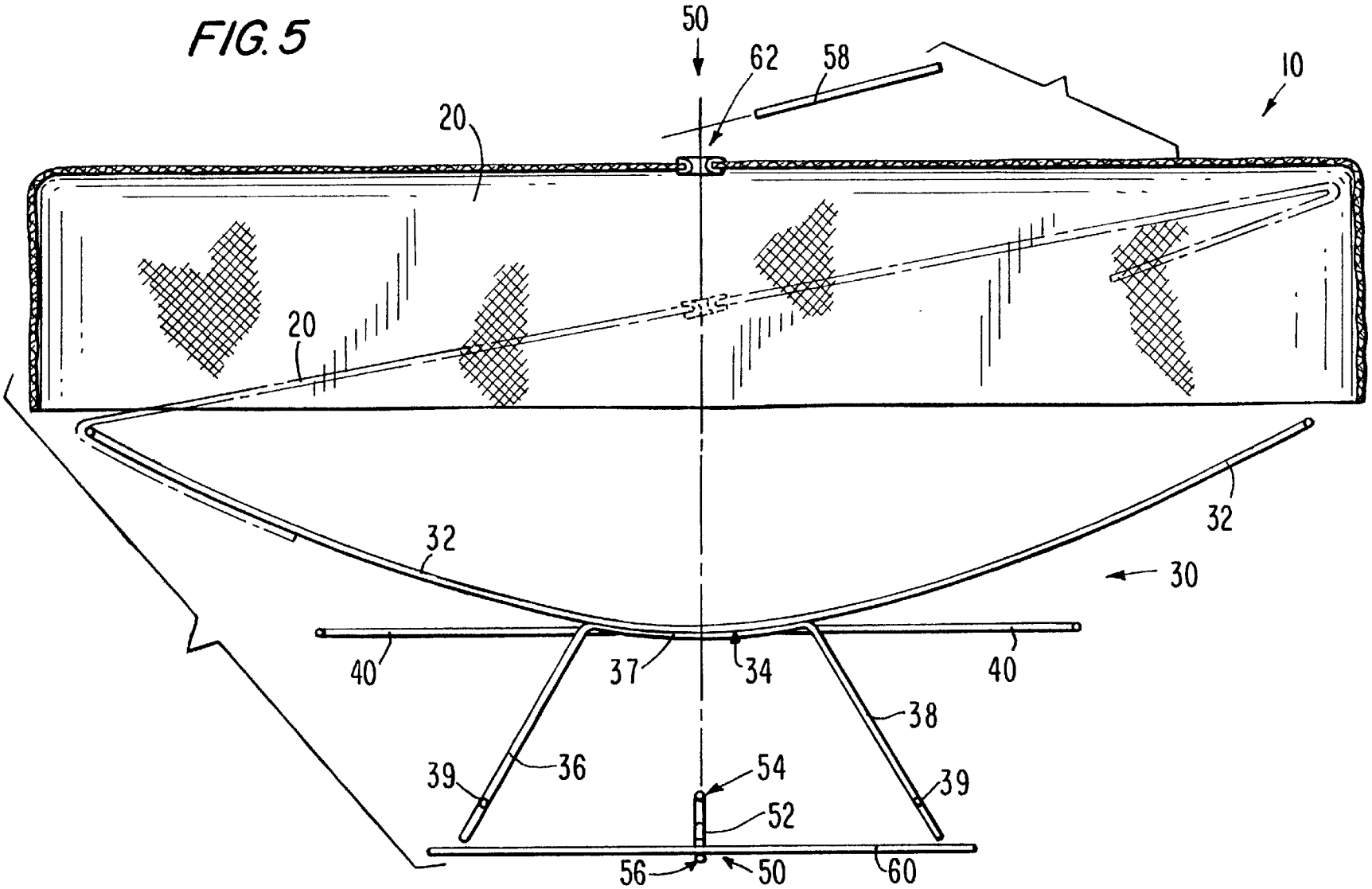
FIG. 5 is an exploded cross-sectional elevational view of the receptacle of FIG. 1, showing how the fabric is removable from the frame of the receptacle.

Frame 30, as best seen in FIGS. 2, 3 and 5, has frame 10 members 32, 34 and 40. Frame member 32 is the upper rim of the open-faced receptacle 10, around which fabric 20 is removably secured (see FIGS. 2–4). Frame member 34 is the support portion of frame 30, supporting- the entire bowl surface which is created by the combination of frame member 32 is and fabric 20. Frame member 34 consists of members 36, 37, 38, 39 and 42. As seen in FIGS. 2–5, frame member 34 extends from frame member 32 (at member 37, see FIGS. 3 and 4), downward as leg members 36 and 38 to support surface contact points 42 (see FIGS. 2 and 3). Leg members 36 and 38 are connected by members 39.

Frame 30 is preferably constructed of metal wire, but it is anticipated by the invention that any material can be used to form frame 30. Examples of different materials could be ceramics, glass, wood or plastics.

Regarding frame member 40, as best seen in FIGS. 2 and 4, member 40 is a substantially horizontally placed, substantially circular frame element which lends fabric 20, in its taunt position, extra support. Member 40 creates a situation where fabric 20 is closer to a horizontal plane in the upper portions than it is closer to a more sloped plane near securing assembly 50. This is best seen in FIG. 1 where in and around 22, fabric 20 is supported on member 40, with area 24 of fabric 20 having the more horizontal orientation, and area 26 of fabric 20 having the steeper, more vertical orientation. Obviously, the exact shape of the fabric will be determined by the exact shape of the frame, and variations of such shapes are all within the scope of the present invention.

Fabric 20 can be of any flexible or non-flexible natural or man-made fabric. It is able to have different designs printed or otherwise formed on it. Fabric here is meant to include virtually any thin flexible material, usable for the purposes herein described.

Fabric 20 is constructed in such a way that it fits securely over frame member 32, with an overlapping flap area 21 fitting about member 32. In the embodiment shown in FIGS. 1–5, fabric 20 does not have an elastic element within flap 21, and instead is securely held around member 32 through means of securing strap 70. As seen in FIG. 2, securing strap 70 is tied on the bottom on receptacle 10 creating tension of fabric 20 around member 32.

Figure 9:
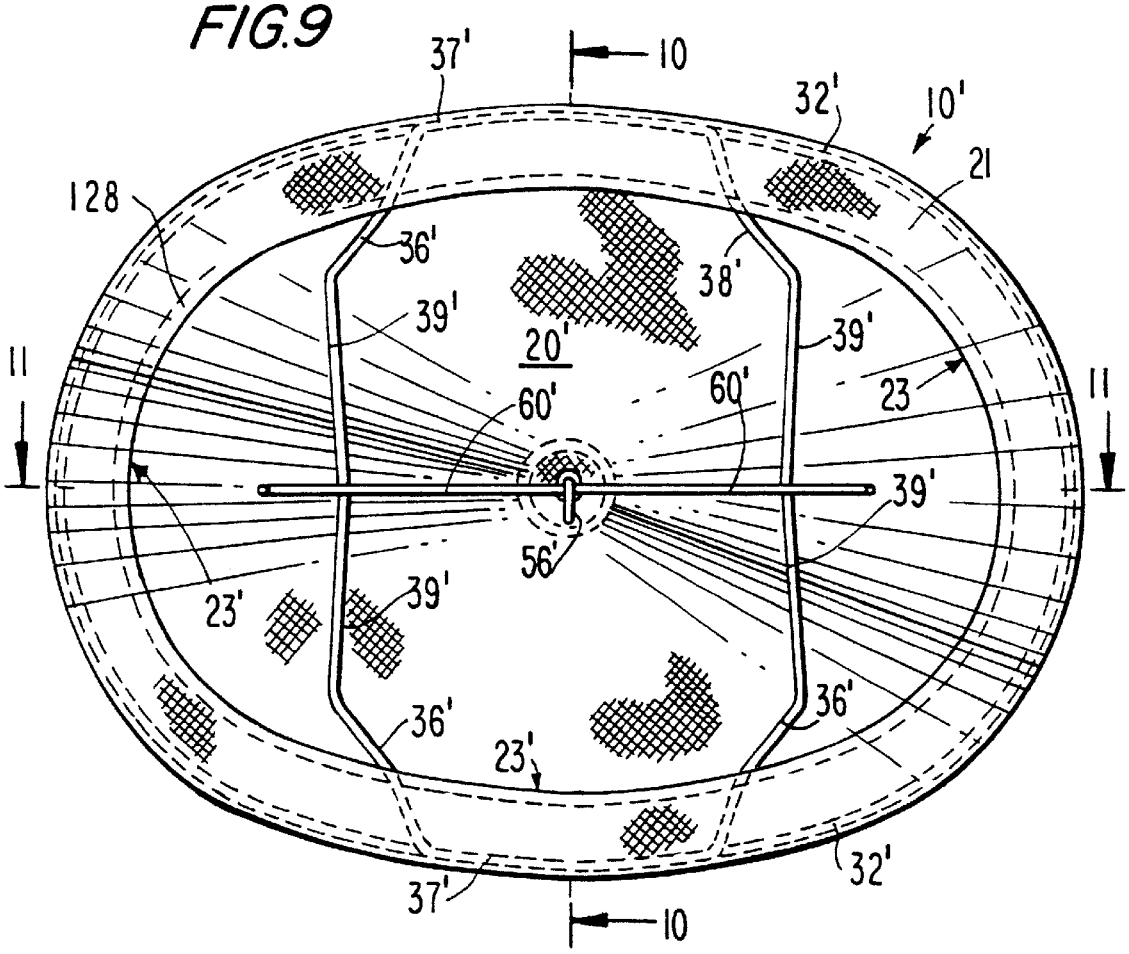
FIG. 9 is a bottom plan view of the receptacle of FIG. 8, showing a removable bar member.
Figure 10:
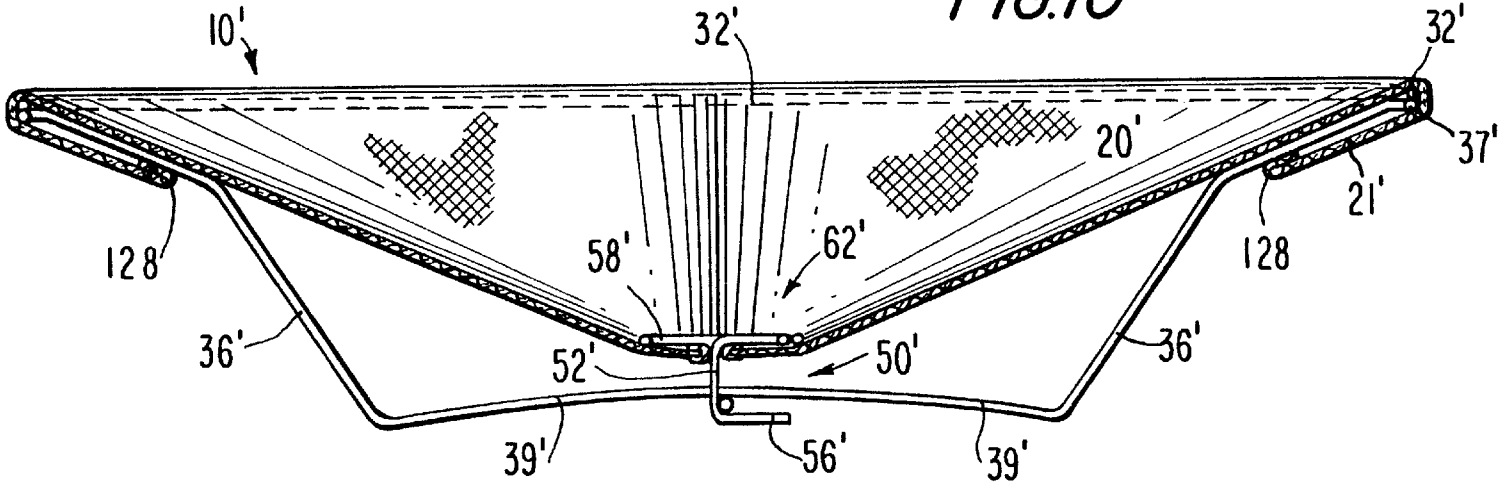
FIG. 10 is a cross-sectional view taken along line 10—10 of FIG. 9.
Figure 11:
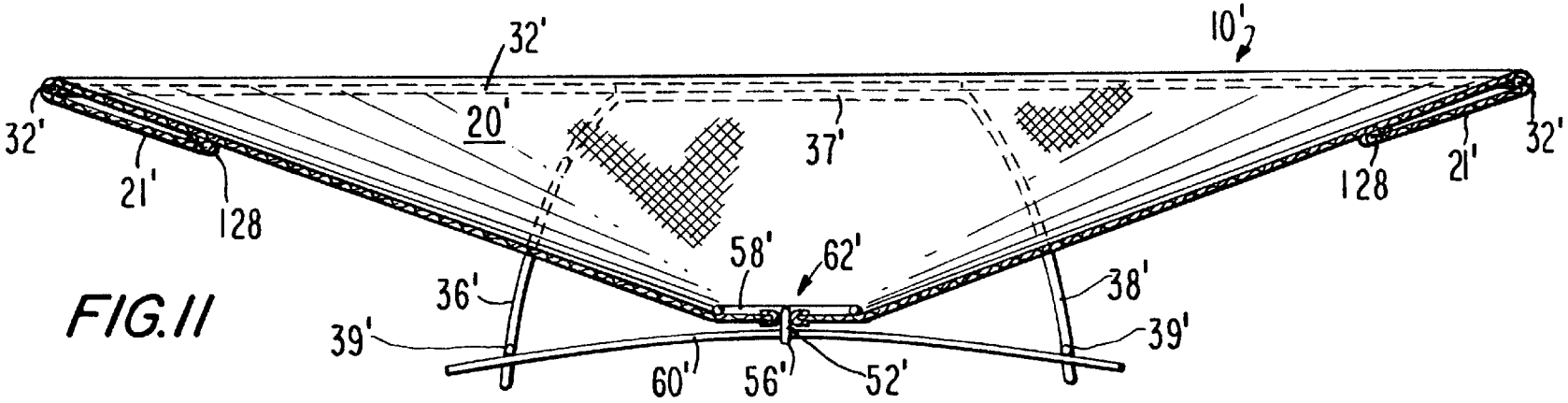
FIG. 11 is a cross-sectional view taken along line 11—11 of FIG. 9.

As will be discussed later in connection with the second embodiment of the invention, fabric 20 can also have an elastic element (element 128 of FIG. 9) which creates the security of fabric 20 over member 32, without the need of securing strap 70.

Fabric 20 is desirably washable, and one of the advantages of the invention is that a person using the inventive device as a fruit bowl, for example, which can get dirty from spoiled fruit or dirty hands, can easily remove and clean fabric 20 by following standard washing instructions. Fabric 20 can also be replaced with other fabrics 20, having different designs or colors, so that the same bowl or dish can be used over and over again on different holidays, showing different themes in fabric 20's design.

An additional element of fabric 20 can be an extension of fabric 20 (not shown) around its edge 23. The extra fabric is used for covering items in receptacle 10. Said items can include, but are not limited to, hot bread, for which the extra fabric helps keep warm.

Regarding securing assembly 50, it comprises hook element 52, having upper portion 54 and lower portion 56, hold-down member 58 and bar member 60. In practice, securing assembly 50 operates when hold-down member 58 is secured through upper portion 54 of hook 52, hook 52 extends through opening 62 of fabric 20 (see FIG. 5), and lower portion 54 of hook 52 receives bar member 60 therethrough and bar member 60 is restrained in position against frame members 39 (see FIGS. 14).

As seen in FIG. 5, fabric 20 is easily removable from frame 30 by removing bar 60 from engagement with lower portion 56 of hook 52, and allowing hook 52 to exit upward through opening 62 of fabric 20 so as to allow for release of hold-down member 58.

Figure 6:
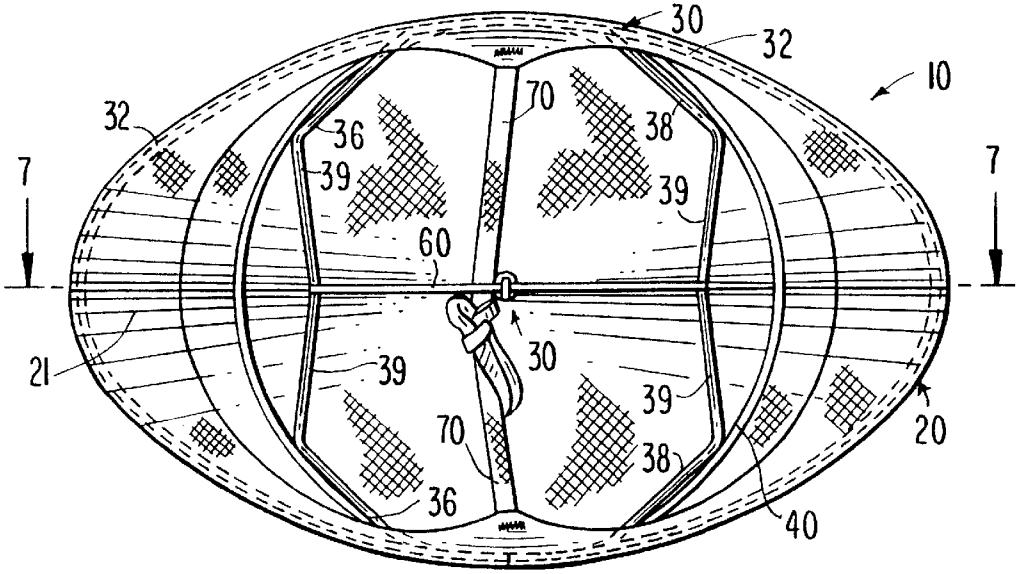
FIG. 6 is a bottom plan view of an alternate embodiment of the receptacle of FIG. 1, showing a welded-on bar member.
Figure 7:
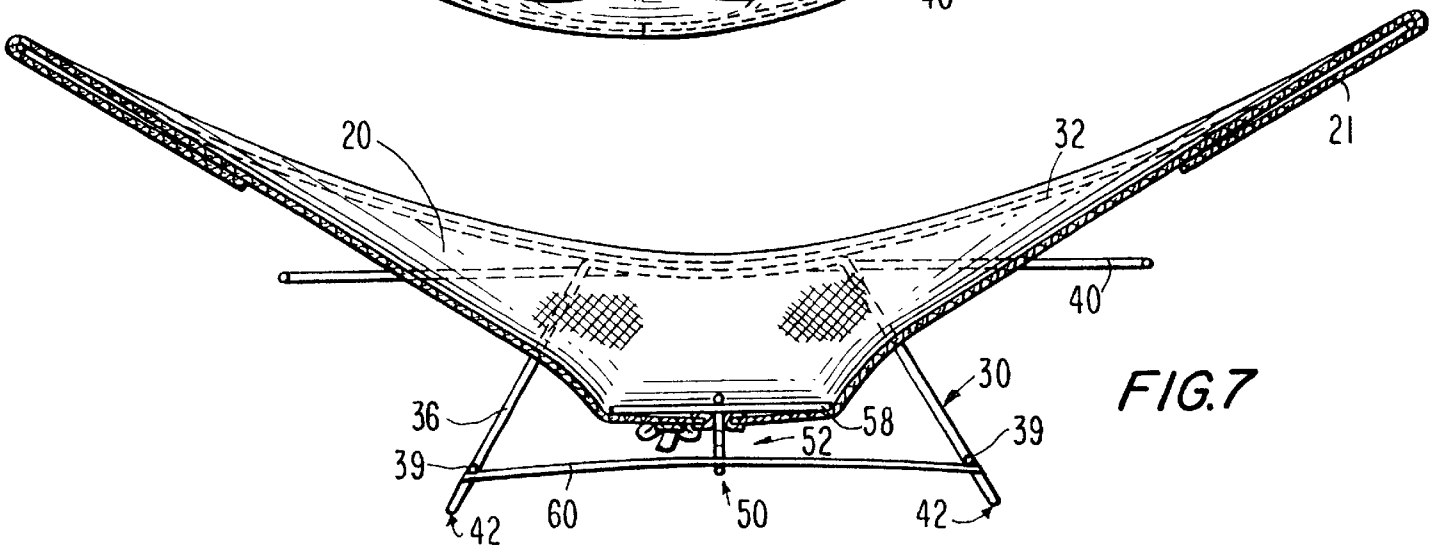
FIG. 7 is a cross-sectional view taken along line 7—7 of FIG. 6.

Directing attention now to the alternate embodiment of the embodiment of FIGS. 1–5, as is shown in FIGS. 6 and 7, the only difference in this alternate embodiment is that bar 60 is no longer removable from frame 30, but is instead welded or otherwise secured to the members 39. In this embodiment, the user of receptacle 10 would need to push down on the center portion of fabric 20 where opening 62 is located so as to loosen hold-down member 58 for removal from upper portion 54 of hook 52. With hold-down member 58 removed, hook 52 will be removed from opening 62, and fabric 20 can be removed from frame 30.

Directing attention now to the second embodiment of the invention, as shown in FIGS. 8–12, the essential structure and function of the invention is the same as has been described for the embodiment of FIGS. 1–7. However, embodiment 2 shows elastic 128 in flap 21' of fabric 20' (see FIG. 9). Another distinction is frame 30' of FIGS. 8–12 does not require frame member 40.

Finally, securing assembly 50', while identical in purpose to securing assembly 50, is constructed differently. In this embodiment, securing assembly 50 consists of two independent pieces, not three independent pieces. More particularly, in this embodiment, hook 52', has a lower portion 56', but no upper portion 54'. Instead, hold-down member 58' acts as both the upper portion of hook 52', and the hold-down member. This creates a uniform or combined hook 52' and hold-down member 58'.

In operation, securing assembly 50' operates by inserting hook 52' through opening 62' in fabric 20' so that lower portion 54' engages bar 60'. In this position, hold-down member 58' engages a small central portion of fabric 20' to hold fabric 20' in its taunt concave shape, while member 60' is positioned against frame members 39'.

As with embodiment 1, bar 60' can be disengaged from connection with members 39' so as to release hook 52' for removal through opening 62', and removal of fabric 20' from frame 30'.

Figure 8:
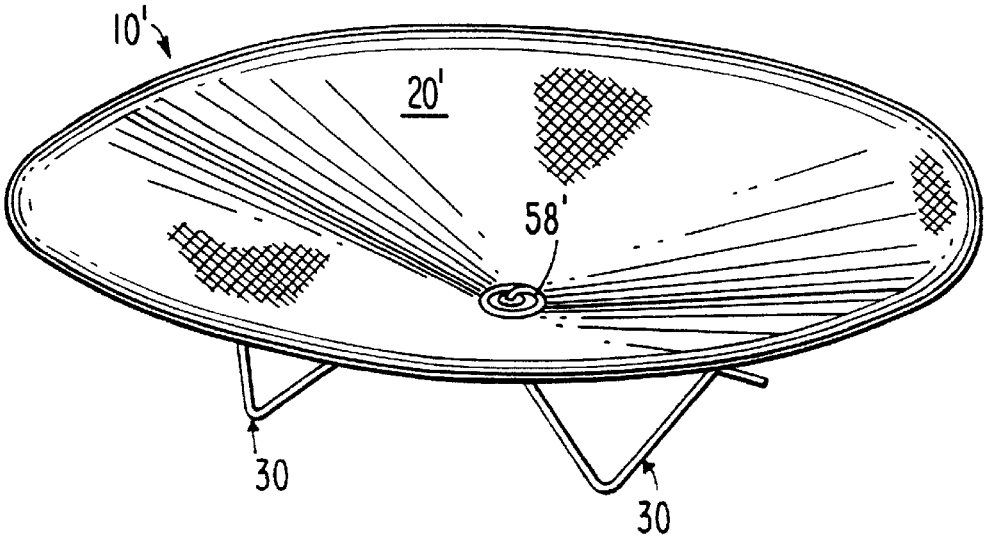
FIG. 8 is a perspective view of a second embodiment of an open-faced receptacle made in accordance with the invention.
Figure 12:
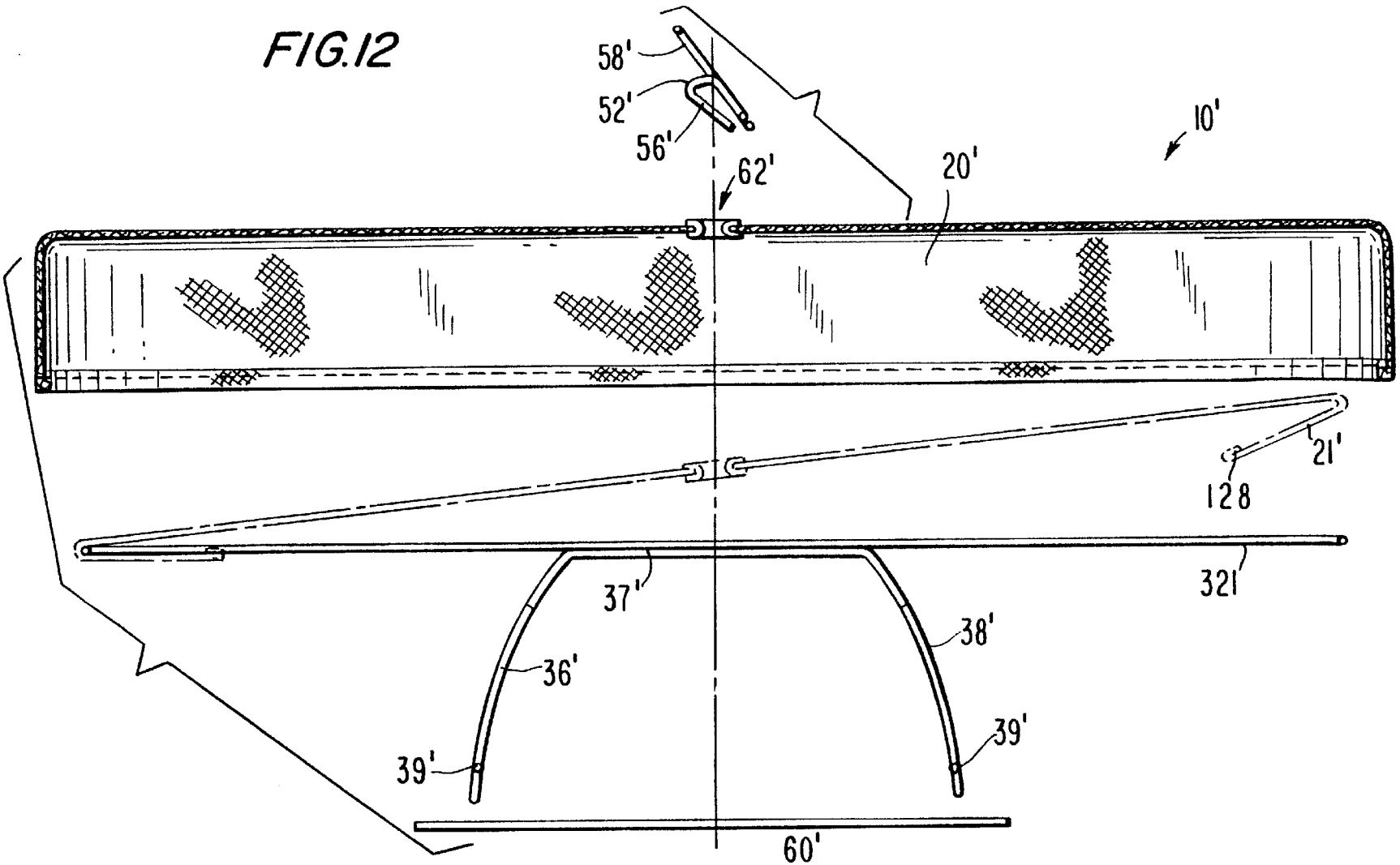
FIG. 12 is an exploded cross-sectional elevational view of the receptacle of FIG. 1, showing how the fabric is removable from the frame of the receptacle.
Figure 13:
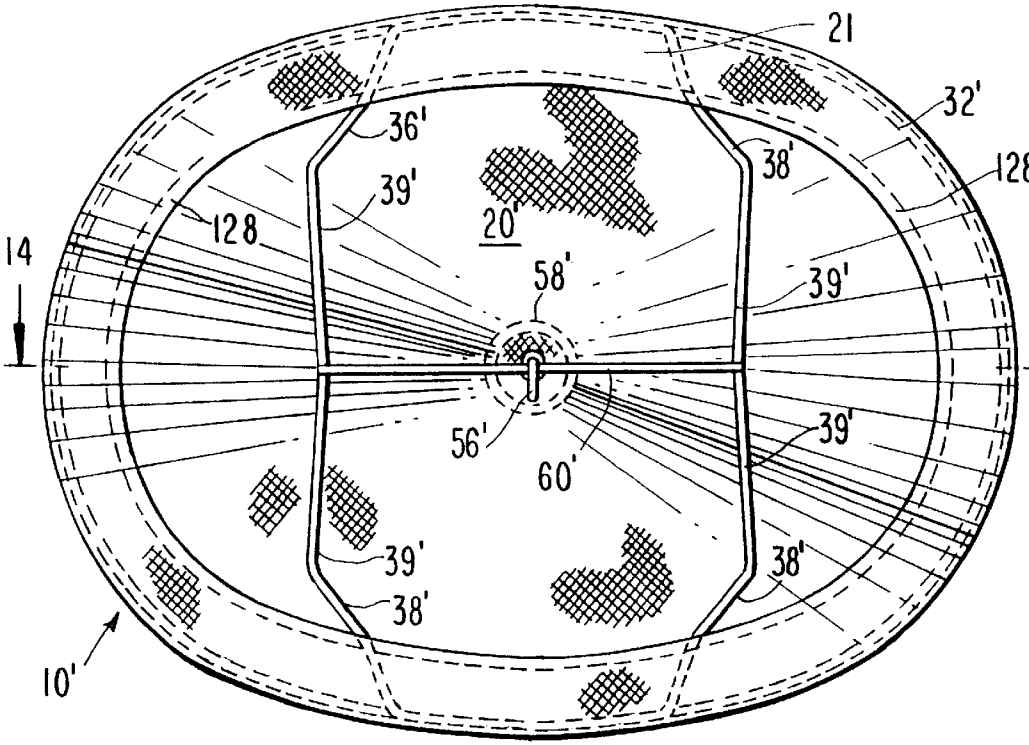
FIG. 13 is a bottom plan view of an alternate embodiment of the receptacle of FIG. 8, showing a welded-on bar member.
Figure 14:
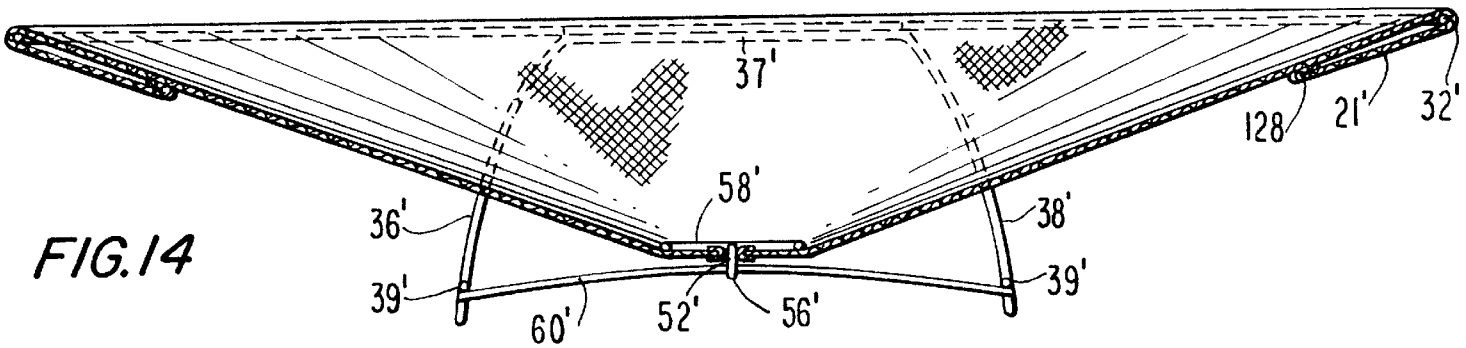
FIG. 14 is a cross-sectional view taken along line 14—14 of FIG. 13.

In an alternate embodiment to that shown in FIGS. 8–5 12, bar 60' can be welded or otherwise secured to frame members 39' (see FIGS. 13 and 14). As with the first embodiment of the invention, if bar 60' is welded to frame members 39' to disengage hook 52', the user must press down on the central portion of fabric 20'. This allows for lower portion 56' to unhook from its engagement with bar 60', thereby allowing for removal of hook 52' through opening 62', and for removal of fabric 20' from frame 30'.

Figure 15:
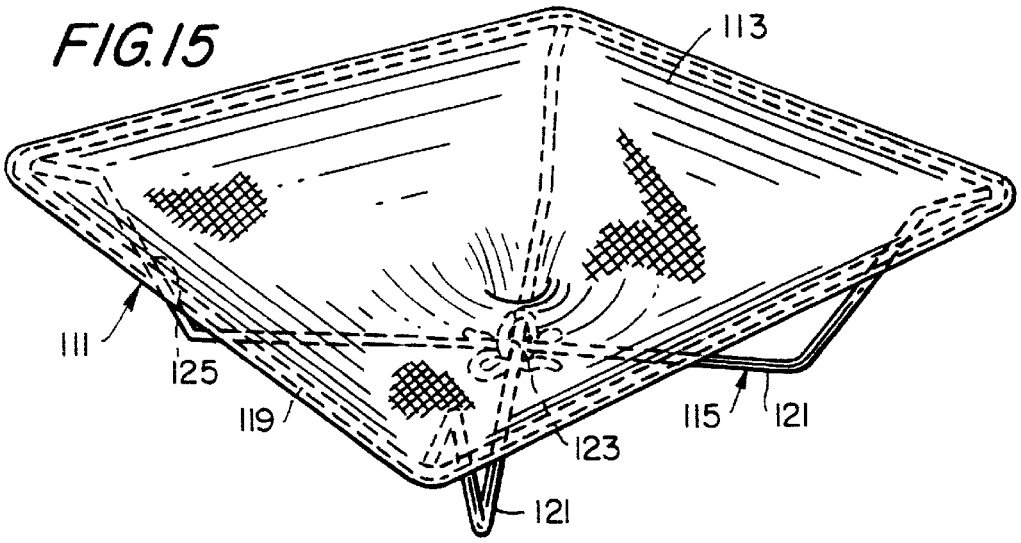
FIG. 15 is a perspective view showing a further embodiment of the inventive open-faced receptacle.
Figure 16:
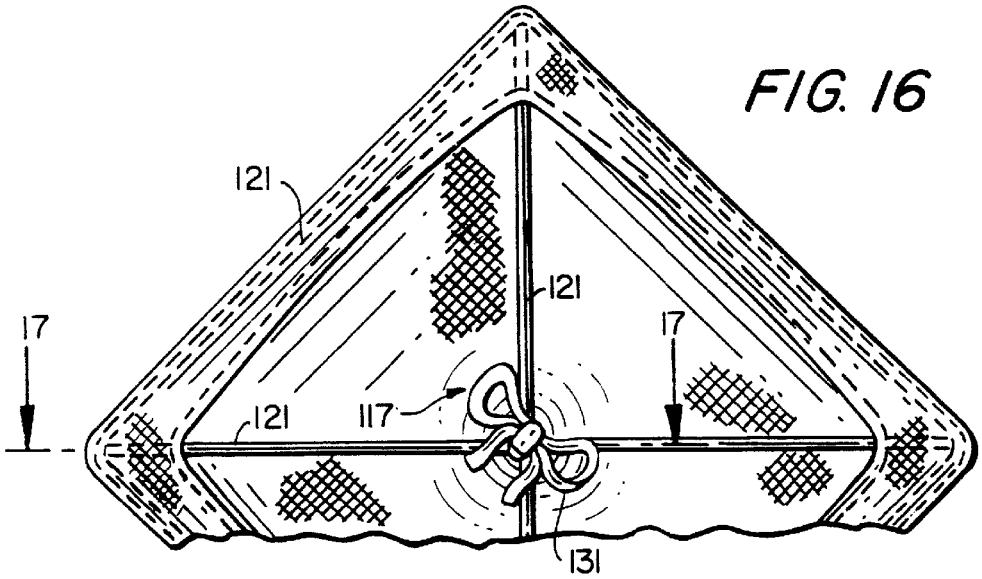
FIG. 16 is a bottom plan view of the receptacle depicted in FIG. 15.
Figure 17:
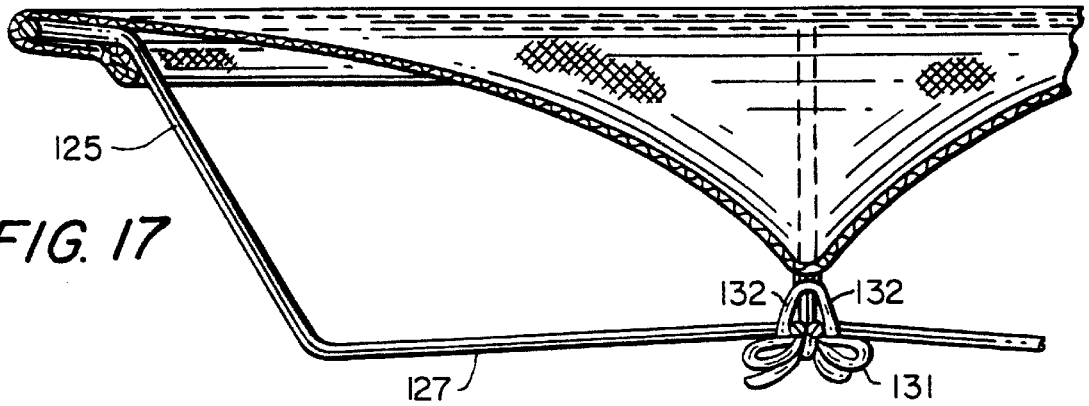
FIG. 17 is a cross-sectional view taken along line 17—17 of FIG. 16.

Referring now to FIGS. 15–17, a further embodiment of the inventive open-faced receptacle made in accordance with the invention is generally indicated at 111. Receptacle 111 includes a fabric 113, a frame 115 and securing assembly 131. Frame 115 comprises a rim 119 around which fabric 113 is removably secured, and a series of inwardly-directed legs 121 depending from rim 119 at the corner thereof. Each of legs 121 has an arm element fixed to and extending down from rim 119, and a support element 127 which is used for supporting receptacle 111 on a surface. Each of support elements 127 is fixed together at one end in order to define a joint 123.

As before, frame 115 is preferably constructed of metal wire, but any other material may be used without departing from the spirit and scope of the invention. Other materials could include ceramic, glass, wood or plastics.

Fabric 113 is made of a stretchable elastic fabric material. Fabric 113 may be opaque or partially transparent, depending in part upon the extent to which the fabric is stretched during use. Fabric 113 is formed with a continuous outer flap 129 along the outer edge thereof, and is sized to fit over frame 115 with flap 129 wrapping about rim 119.

Securing assembly 117 comprises a ribbon 131 sewn to a substantially central location of fabric 113 along the underside thereof. Ribbon 131 comprises a pair of ribbon elements which are designed to be tied to frame 115 by wrapping about joint 123, as best depicted in FIGS. 16 and 17. When ribbon 131 is tied or otherwise secured to frame 115, fabric 113 is stretched inwardly and down (see FIG. 17), thereby defining a bowl-like configuration. As can be appreciated, fabric 113 may be removed from frame 115 by first untying ribbon 131 from frame 115, and then disengaging outer flap 129 from rim 119.

Turning now to the embodiment described in FIGS. 18–20, a further open-faced receptacle made in accordance with the invention and generally indicated at 211 is now described. Receptacle 211 includes fabric 213, frame 215 and a securing ring 217. Frame 215 includes a rim 219 about which fabric 213 is secured, and a series of inwardly-directed legs 221 depending from the corners of rim 219. Legs 221 each is formed with a downwardly directed arm element 225 connected to rim 219, and a support element 227 for use in supporting receptacle 211 on a surface. As before, each of support elements 227 have their ends fixed together in order to define a joint 223. Joint 223 defines a central location of frame 215 underneath fabric 213.

Fabric 215 is made from a stretchable elastic fabric material, and is sized to stretchably fit around frame 215 by means of flap 229 wrapped about rim 219. Fabric 213 has a pair of substantially centrally located adjacent holes 231 through which ring 217 is permanently fit. Ring 217 is also slidably and permanently secured to one of support elements 227 (see FIG. 19), thus downwardly pulling fabric 213 toward joint 223 of frame 215, as shown in FIG. 20. As can be appreciated with this embodiment, fabric 213 is not removable from frame 215.

Figure 21:
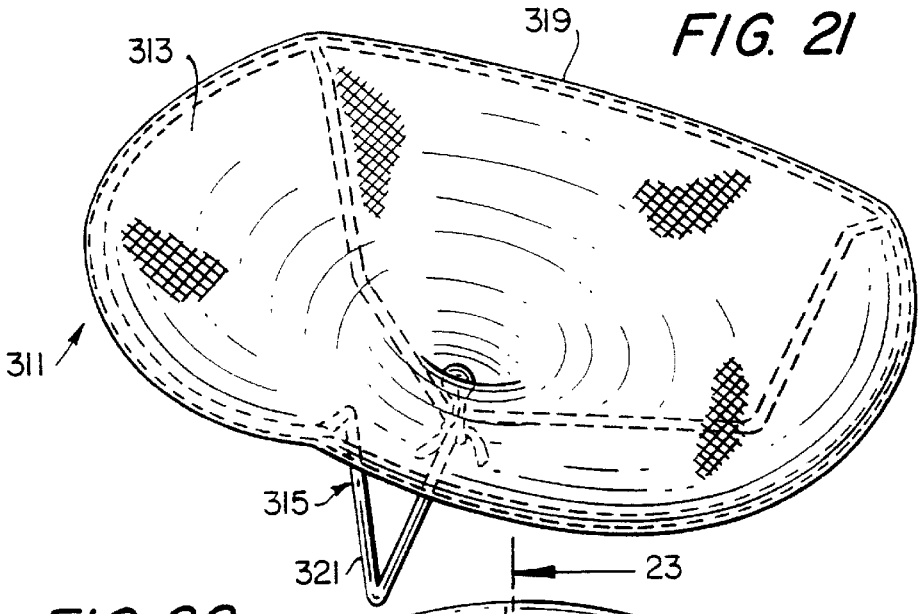
FIG. 21 is a perspective view of still a further embodiment of the inventive open-faced receptacle.
Figure 22:
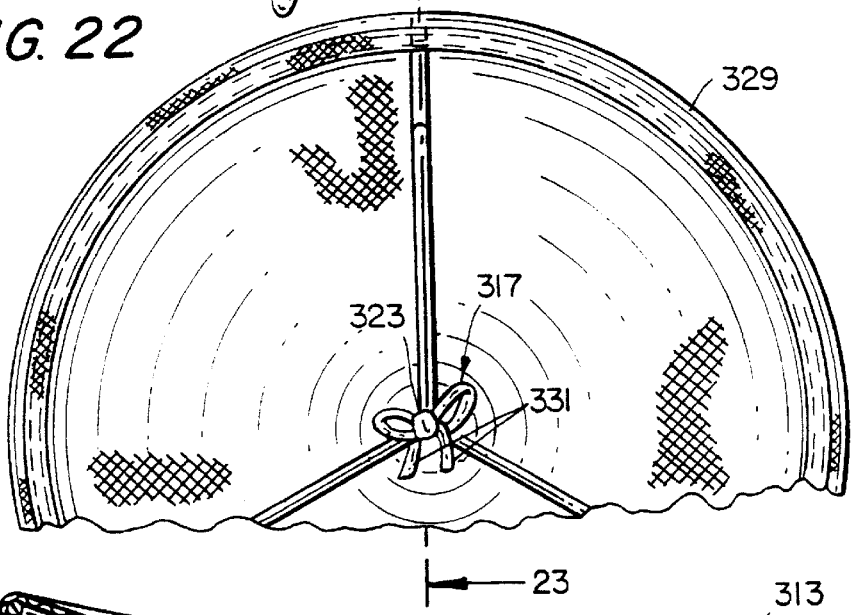
FIG. 22 is a bottom plan view of the receptacle depicted in FIG. 21.
Figure 23:
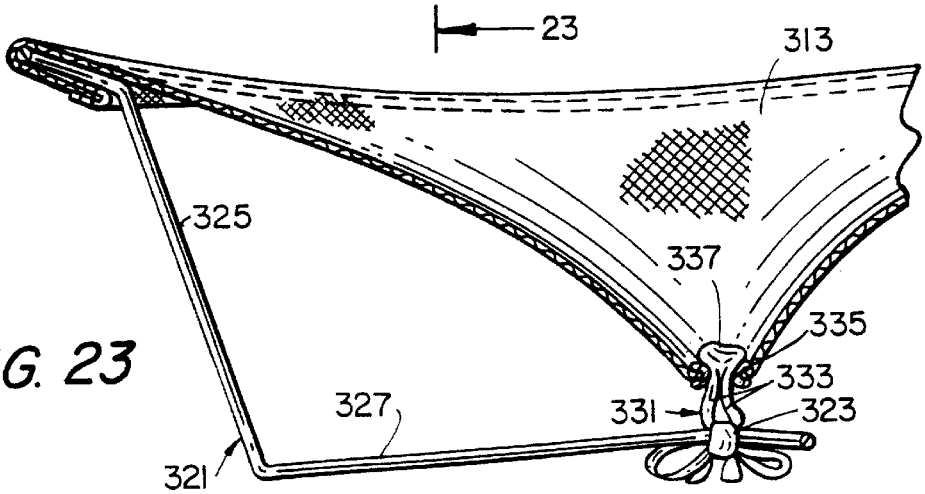
FIG. 23 is a cross-sectional view taken along lines 23—23 of FIG. 22.

Turning now to FIGS. 21–23, still another embodiment of the inventive open-faced receptacle is shown and generally indicated at 311. Receptacle 311 includes fabric 313, frame 315 and a securing member 317. Frame 315 is defined by an upper oblong shaped rim 319 around which fabric 313 is removably secured, and a series of legs 321 depending inwardly therefrom. In this embodiment, there are three legs 321, and each includes an arm element 325 and a support element 327, as described before. Each support element 327 has ends joined with one another in order to define a joint 323.

Fabric 313 is sized to fit over frame 315, and is formed with an outer flap therearound sized for selectively wrapping about rim 319. As with the previous embodiments, fabric 313 is made from an elastic stretchable fabric material that is either opaque or partially transparent.

In the embodiment depicted in FIGS. 21–23, securing member 317 is defined by a ribbon 331 fixed to and depending from the central underside surface of fabric 313. Ribbon 331 includes a pair of ribbon elements 333 having first ends fitted through a central opening 335 formed in fabric 313. These ends of ribbon 333 are then tied together in order to define a stop 337 of a size somewhat larger than opening 335, thereby preventing ribbon elements 333 from passing therethrough.

The other end of ribbon elements 331 may be selectively tied around frame 315 at joint 323 in order to stretchably and downwardly pull fabric 313, thereby defining a bowl-shaped form (see FIGS. 21 and 23). In order to remove fabric 313 from frame 315, ribbon elements 333 are untied from joint 323 and flap 329 is removed from position overlying rim 319.

Turning now to the embodiment depicted in FIGS. 24–26, a further version of the inventive open-faced receptacle is generally indicated at 411. Receptacle 411 comprises a fabric 413 and a frame 415. Frame 415 is defined by a rim 419 about which fabric 413 is removably secured, and two pairs of oppositely directed legs 421A and 421B inwardly depending therefrom at the corner thereof. Each of legs 421A and 421B has an arm element 425 fixed to and extending from rim 419, as well as a support element 427A and 427B respectively.

As shown, support elements 427A of legs 421A are fixed to one another at a joint 434 in order to define a V-shaped support 433. Support elements 427B of legs 421B extend substantially parallel to each other and are fixed to elements 427A of legs 421A of joint 434. Each support element 427B of legs 421B have an end 435 extending past joint 434.

Fabric 413 is sized to fit over frame 415, and is formed with a flap 424 around the outer edge thereof for fitting about rim 419. Fabric 415 is formed with a pair of substantially centrally located openings or slit 441 for selectively receiving therethrough ends 435 of support elements 427B (see FIGS. 2 and 3). When ends 435 are so disposed, the central portion of fabric 413 is stretchingly pulled down, thereby defining a bowl-shaped design.

Fabric 413 can be easily removed from frame 415 by removing ends 435 from engagement within openings 441 and then removing flap 429 of fabric 413 from position around rim 419.

Turning now to FIGS. 27–30, a foldable version of a frame for use as part of the inventive open-faced receptacle is generally indicated at 515. Frame 515 comprises a rim 519 and a pair of foldable legs 521A and 521B. Each of legs 521A and 521B includes a pair of arm elements 525 pivotally attached at one end to opposite corners 531 of rim 519, and a support bar 527A and 527B respectively extending between arm elements 525. Each support bar 527A and 527B is connected at each end to arm elements 525 in a continuous fashion and in such a design as to define a pair of feet 529. As can be appreciated from FIG. 13, support bar 527 of legs 521 sits directly over support bar 527B of leg 521B such that bar 527B is received in a notch 528 of bar 527A when frame 515 is disposed in a standing condition.

Referring specifically now to FIG. 28, one of arm elements 525 of either leg 521A or 521B is shown in greater detail in terms of its pivotal connection to corner 531 of rim 519. Corner 531 is formed with a hole 533 sized for accommodating a pivot pin 535 which is fixed to the upper end of arm element 525. Pivot pin 535 enables arm element 525 to pivotally swing with respect to rim 519. Similar connections are provided at the other corners of rim 519 where arm elements 525 are connected.

As can be appreciated from viewing FIG. 16, frame 515 is shown in a substantially collapsed condition with each of legs 521A and 521B disposed substantially along the same plane as rim 519. This collapsed condition is achievable due to the pivotal connection of arm element 525 of each of legs 521A and 521B to corners 531 of rim 515, and enables frame 513 to be more conveniently packaged and stored.

It will thus be seen that the objects set forth above, among those made apparent from the preceding description, are efficiently attained, and, since certain changes may be made in the above constructions without departing from the spirit and scope of the invention, it is intended that all matter contained in the above description and shown in the accompanying drawings shall be interpreted as illustrative and not in a limiting sense. It is also to be understood that the following claims are intended to cover all of the generic and specific features of the invention herein described and all statements of the scope of the invention, which, as a matter of language might be said to fall therebetween.

We claim:

1. An open-faced receptacle comprising:

a supporting frame;

an elastic fabric member secured over said frame;

a securing member for pulling a substantially central portion of said fabric member toward a lower portion of said frame by selectively connecting said central portion to said frame;

the fabric when secured around said frame and when pulled toward said lower portion of the frame forming an open receiving face having a taut substantially continuously curved concave shape;

said fabric being stretchable between an essentially flat position spanning said frame and a position defining said taut continuously curved concave shape.

2. The receptacle of claim 1, wherein said securing member comprises a fabric element fixed to and depending down from said central portion of said fabric member.

3. The receptacle of claim 2, wherein said fabric element is tieable to said lower portion of said frame.

4. The receptacle of claim 1, wherein said securing member comprises a hold-down element coupled to said frame.

5. The receptacle of claim 4, wherein said hold-down element is coupled to said central portion of said fabric member.

6. The receptacle of claim 5, wherein said hold-down member comprises a hook element.

7. The receptacle of claim 6, wherein said central portion of said fabric member has at least one opening by which said hook element is coupled to said fabric member.

8. The receptacle of claim 7, wherein said hook element comprises a loop member.

9. The receptacle of claim 7, wherein said hook element comprises an element of said frame.

10. The receptacle of claim 1, wherein said frame is foldable between a first supporting condition when said fabric member is secured therearound and a second collapsed condition.

11. The receptacle of claim 1, wherein said frame comprises an upper rim about which said fabric member is removably secured and a plurality of supporting legs depending from said rim.

12. The receptacle of claim 11, wherein said securing member is connectible between at least one of said legs and said central portion of said fabric member.

13. The assembly of claim 11, wherein each of said plurality of legs includes a supporting element by which said frame is supported on a surface.

14. The receptacle of claim 12, wherein said plurality of legs are joined at a substantially central location underneath said fabric member.

15. The assembly of claim 14, wherein said securing member is connectible between said joined substantially central location of said legs and said central portion of said fabric member.

16. The assembly of claim 1, wherein said elastic member is removably secured over said frame.

17. The assembly of claim 1, wherein said elastic member is secured around a rim of said frame.

18. The receptacle of claim 1, wherein said elastic member is fixedly secured over said frame.

* * * * *